US012376627B1

(12) United States Patent
Herskovic et al.

(10) Patent No.: US 12,376,627 B1
(45) Date of Patent: Aug. 5, 2025

(54) NECKLINE FITTING SYSTEM

(71) Applicant: Aheadwear LLC, Monroe, NY (US)

(72) Inventors: Devora Herskovic, Monroe, NY (US); Israel Herskovic, Monroe, NY (US)

( * ) Notice: Subject to any disclaimer, the term of this patent is extended or adjusted under 35 U.S.C. 154(b) by 0 days.

(21) Appl. No.: 18/904,801

(22) Filed: Oct. 2, 2024

(51) Int. Cl.
*A41B 3/02* (2006.01)

(52) U.S. Cl.
CPC ..... *A41B 3/02* (2013.01)

(58) Field of Classification Search
CPC .... A41B 3/02; A41B 1/16; A41D 1/02; A41D 2300/30; A41D 2300/22; A41D 13/1245
See application file for complete search history.

(56) References Cited

U.S. PATENT DOCUMENTS 586,132 A * 7/1897 Lane ..... A41D 3/08 2/88
2,524,775 A * 10/1950 De Grazia ..... A42B 1/045 2/88
2,685,691 A * 8/1954 Artz ..... A41B 9/08 2/113
2,698,944 A * 1/1955 Ramsby ..... A41D 15/00 2/48
2,994,884 A * 8/1961 Bevington ..... A41B 13/005 2/78.3
3,633,215 A * 1/1972 Richards ..... A41D 15/04 2/105
4,057,854 A * 11/1977 Phelps, Sr. ..... A45F 5/00 2/128
10,441,059 B1 * 10/2019 Catlin ..... A45D 44/08
2006/0253958 A1 * 11/2006 Debrick ..... A41D 27/18 2/206
2011/0154554 A1 * 6/2011 Furlong ..... A41D 13/1209 2/114
2013/0239285 A1 * 9/2013 Jonason ..... A41D 13/1209 2/51
2014/0000010 A1 * 1/2014 Geary ..... A41F 1/00 2/336
2015/0223530 A1 * 8/2015 Grieco ..... A41D 20/00 2/209.3
2017/0251843 A1 * 9/2017 Kennedy ..... A47G 11/001
2021/0106084 A1 * 4/2021 Markoglou ..... A41D 13/1236
2022/0030983 A1 * 2/2022 Levine ..... A41D 13/129
2023/0020635 A1 * 1/2023 Graham ..... A41D 20/00

* cited by examiner

*Primary Examiner* — Jillian K Pierorazio

(57) ABSTRACT

The neckline fitting system provides an adjustable and customizable fit for apparel worn on the upper torso, such as shirts or blouses. The system includes one or more channels integrated into the neckline of the garment, each housing an elastic member. The elastic member can be adjusted to modify the tightness of the neckline around the wearer's neck. One of the elastic members are adjustable using a fastening mechanism, such as a cord lock, allowing the wearer to fine-tune the fit.

20 Claims, 3 Drawing Sheets

NECKLINE FITTING SYSTEM

SUMMARY

Described herein is a novel neckline fitting system, the parts of which operate to achieve a perfect fit for a wearer's neck. The neckline fitting system may be coupled or incorporated into any relevant article of apparel which may be worn on at least the upper torso of a wearer, such as a shirt or blouse.

The neckline fitting system may in a first embodiment feature a first channel formed by the material comprising the neckline. This first channel may span across a front of the neckline and around and toward and encompassing the sides. The first channel may optionally span around the back of the neckline as well. In one variation, the first channel spans a back of the neckline and around and toward the sides, and may optionally span around the front of the neckline as well.

In this embodiment, the first channel may comprise an inner member for controlling the tightness of the neckline vis-à-vis a wearer's neck. The inner member may be slightly or substantially elastic, and may accordingly be understood as an elastic member. The elastic member may be a cord, string, strap, band, or any other shape or size or style of relatively thin, long, and string-like thing. The elastic member may be round or, in a preferred embodiment, relatively flat, in the manner of a linguine. The elastic member may be elastic in nature in the sense that it has a resting length, but can be pulled to a longer length when a force is applied. This force may be applied actively, as when a wearer pulls the neckline over the wearer's head, causing it to stretch due to the greater relative diameter of the head than the resting length, and then it may be applied passively, as when a wearer simply wears the neckline around the wearer's neck, causing a low-level of stretch due to the greater relative diameter of the neck than the resting length. The elastic member may be sewn or otherwise attached along its disposition within the first channel. The attachment may be merely at the ends of the elastic member, or additionally in a segmented fashion throughout, in order to distribute the stretching force throughout the elastic member when being worn. The first channel may be formed by a bias bound hem, a single fold hem, a double fold hem, a blind hem, a bias tape finish, a faced neckline, binding, or any other suitable combination thereof.

The neckline fitting system may in a second embodiment feature a second channel formed by the material comprising the neckline. This second channel may span across a back of the neckline and around and toward and encompassing the sides. The second channel may optionally span around the front of the neckline as well. In one variation, the second channel spans a front of the neckline and around and toward the sides, and may optionally span around the back of the neckline as well.

In this embodiment, the second channel may comprise an inner member for controlling the tightness of the neckline vis-à-vis a wearer's neck. The inner member may be slightly or substantially elastic, and may accordingly be understood as an elastic member. The elastic member may be a cord, string, strap, band, or any other shape or size or style of relatively thin, long, and string-like thing. The elastic member may be flat or, in a preferred embodiment, relatively round, in the manner of a spaghetti. The elastic member may be preferably be minimally elastic in nature in the sense that it has a resting length, but despite the application of a pulling force, not substantially change in its length. The minimal elasticity here may be due to the elastic member being a drawstring, and therefore providing the minimal elasticity due to being constructed of a series of entwining cords, with the elasticity specifically being provided through the entwining cords tightening against each other, and then diminishing when the entwining cords are let to rest. The elastic member may be sewn or otherwise attached along its disposition within the second channel. The attachment may be merely at the ends of the elastic member, or additionally in a segmented fashion throughout, in order to distribute the stretching force throughout the elastic member when being worn.

In this second embodiment, the second channel may comprise an opening allowing access to the elastic member from outside the second channel, with the opening being "raw", or maintained via a metal clamping eyelit or through a sewn enclosure. The elastic member here desirably protrudes out of the window allowing it to be grabbed and pulled by a wearer. The portion protruding through the opening may be maintained in its externalized condition by means of a fastening tab, which may be a small clamp, toggle, stop slider, or barrel cord lock. Such components typically feature a spring loaded inside a cannister, with the spring engaged between a bottom of the cannister and a plunger and configured to press the plunger at least partially outside of the cannister. However, the spring can be compressed through the application of the plunger back into the cannister, thereby causing gaps in the cannister to align with gaps in the plunger through which the elastic member be slide more freely in and out. When the spring compression ceases, the alignment is annulled and the elastic member is pressed between the plunger and side walls of the cannister, thereby locking it in place. In one version, the fastening tab is simply a tight silicon widget that must be squeezed or otherwise deformed in order to expand the opening through which the elastic member may slide in and out.

In a preferred variation of this second embodiment, the fastening tab fastens the middle portion of the elastic member, specifically a loop formed by the middle portion, such that two continuous strand-portions are fixed by the fastening tab. The wearer may pull at the portion of loop between these two continuous strand-portions in order to pull the elastic member more fully out of the second channel's opening, and then press the fastening tab's plunger down so that the gaps align, move the fastening tab closer to the back channel opening, and then release the plunger in order for the fastening tab to clamp at the new length, thereby tightening the neckline.

In another variation of this second embodiment, the two ends of the elastic member protrude out through the neckline opening, and the fastening tab fastens two these separate ends of the elastic member, such that each end can be separately pulled by the wearer in order to tighten the left side of the neckline more than the right, or the right side more than the left. In this variation, the elastic member may be bisected into two separate elastic members. In yet another version, each end of the elastic member is coupled to its own dedicated fastening tab.

The second channel may be formed by a bias bound hem, a single fold hem, a double fold hem, a blind hem, a bias tape finish, a faced neckline, binding, or any other suitable combination thereof.

In a third embodiment, the first channel and second channel, with their respective and separate elastic members, may be incorporated into a single neckline fitting system. In a preferred version of this third embodiment, the first and second channel may be treated as a front channel and a back channel. In another variation of this embodiment, the first and second channel may reversely be treated as a back channel and front channel, such that the fastening tab and opening are disposed at the front of the neckline. In a fourth embodiment, the first and second channels merge into a single unified channel, and their respective elastic members merge into a single elastic member. In a preferred variation of this fourth embodiment, the fastening tab and opening are disposed at the back of the neckline; in another variation, the fastening tab and opening are disposed at the front of the neckline.

In a fourth embodiment, in lieu of a first or front channel, the first elastic member is simply sewn along the neckline along the perimeters of the first elastic member, specifically the upper and lower perimeters, onto the interior (hidden) portion of the neckline. In this embodiment, the neckline lacks a bias bound hem; instead, the neckline, as seen from the exterior, is continuous of the material forming the main body of the article of apparel. This may be achieved through a single fold (in which the material is folded over once onto the interior side of the neckline but the edge of the material is exposed) or a double fold hem (in which the material is folded over first onto the interior side of the neckline, and then folded a second time so that the edge is tucked away behind between the fold and the main body of the material, thereby concealing the edge of the material. Here, the upper perimeter of the first elastic member is sewn to the upper perimeter of the folded-over portion of the hem. Using the single fold technique, the upper perimeter of the folded-over portion is near the fold-line itself and on the interior of the neckline. The lower perimeter of the first elastic member is sewn through the exposed edge and into the exterior portion of the neckline so that the (lower perimeter) sew lines may be seen when the article is worn. Using the double fold technique, the upper perimeter of the folded-over portion is near the first fold line, and also on the interior of the neckline. The lower perimeter in this case is sewn through the second fold, and further into the exterior portion of the neckline so that, again, the (lower perimeter) sew lines may be seen when the article is worn. In one variation, in order conceal the lower perimeter sew lines, a blind hem stitch technique may be used. In another variation, the first perimeter is sewn through the edge of the folded-over portion, and the lower perimeter is sewn only through the exterior portion of the neckline and not the folded-over portion. In this variation, the folded-over portion is contained, as it were, between the exterior portion of the neckline and the first elastic member. In this variation, the very small fold may function as a rolled hem.

In one variation of this embodiment, the first elastic member extends around the entire (interior portion) of the neckline—the front as well as the back.

In a fifth embodiment, the second or back channel may be in part formed by, or used in conjunction with the relatively flat, linguine-shaped elastic member that is used as the first elastic member. Thus, this "third" elastic member may partially form the channel through which the second elastic member passes through. Alternatively, this third elastic member is simply sewn into the second or back channel along the upper and lower perimeters, as described previously.

DETAILED DESCRIPTION

Figure 1:
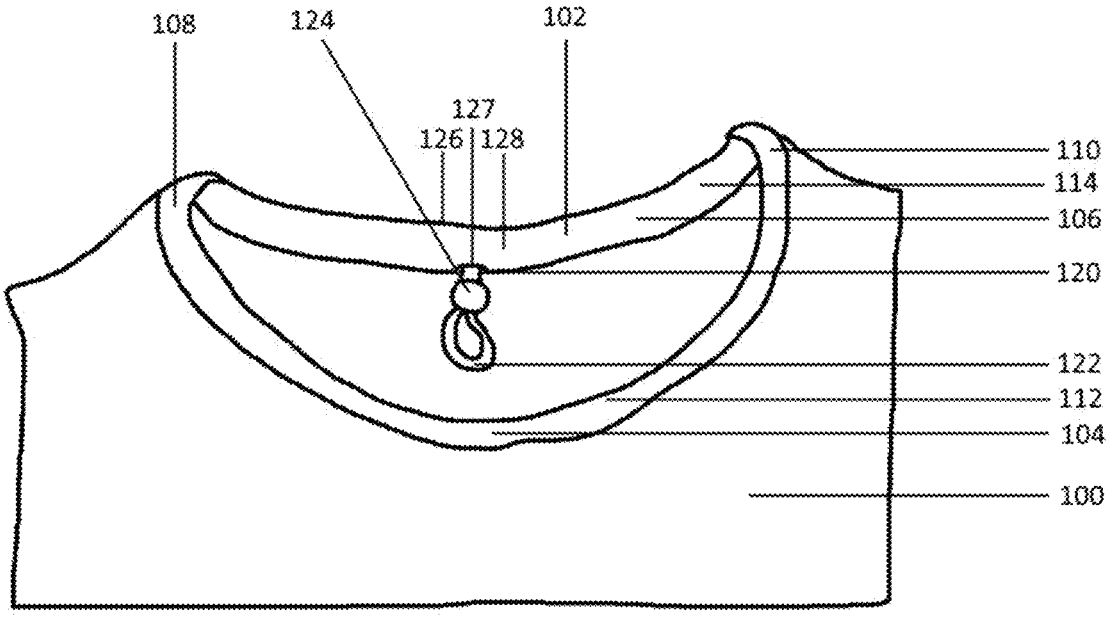
FIG. 1 shows an exemplary neckline fitting system.
Figure 2:
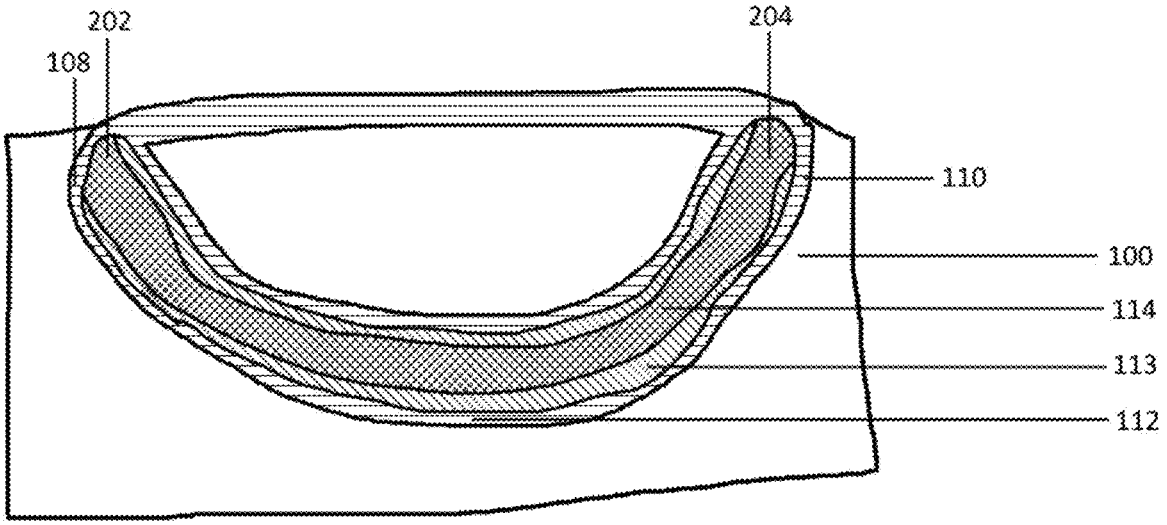
FIG. 2 shows a cut-away view of a front channel of the exemplary neckline fitting system.
Figure 3:
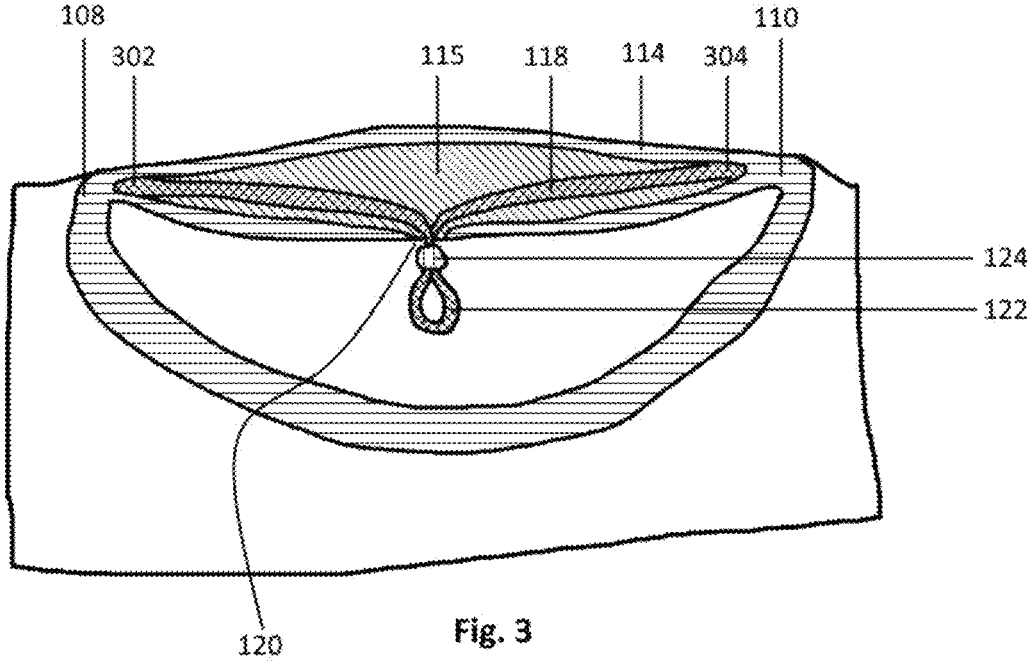
FIG. 3 shows a cut-away view of a back channel of the exemplary neckline fitting system.

As shown in FIG. 1-3, the neckline fitting system may comprise a piece of apparel 100, such as a shirt or dress, although the system may be used for any variety of apparel with a neckline 102. The neckline may have a front side 104, a back side 106, a left side 108, and a right side 110. The neckline may comprise a single channel, a single channel conceptually and/or physically divided into two channel segments, or two distinct channels, including a front channel 112 and a back channel 114. The front channel may span from the left to the right side of the neckline through the front side and the back channel may span from the left to the right side of the neckline through the back side.

Within the channels may be a set of elastic members including a first elastic member 116 and a second elastic member 118. The first elastic member may be substantially flat like a band to retain the flatness of the front channel and the second elastic member may be substantially cylindrical to facilitate tightening of the back channel.

The back side of the neckline may include an opening 120 via an eyehole. Through this opening, a middle portion of the back elastic member may protrude, with the middle portion bunched into a loop 122. This loop may pass through a fastening tab 124, with the fastening tab configured to clasp the middle portion and prevent it from passing back through the opening and back into the back channel. The length of the middle portion protruding through the opening may be controlled by the fastening tab which may be operated by a wearer to release and then reclasp the middle portion along a different length.

The opening may be disposed on a top edge 126 of the back side, a bottom edge 127 of the back side, the front face 128 of the of the back side, or a back face (not shown) of the back side.

FIG. 2 shows a cut-away view of the front channel 112, the hollow space 113 within the front channel, and the first elastic member 114. The first elastic member may have a first end 202 and a second end 204, which may be attached to the left and right side of the neckline, respectively.

FIG. 3 shows a cut-away view of the back channel 114, the hollow space within the back channel 115, the second elastic member 118, the opening 120, the loop 122, and the fastening tab 124. The second elastic member may have a first end 302 and a second end 304, which may be attached to the left and right side of the neckline, respectively.

Figure 4:
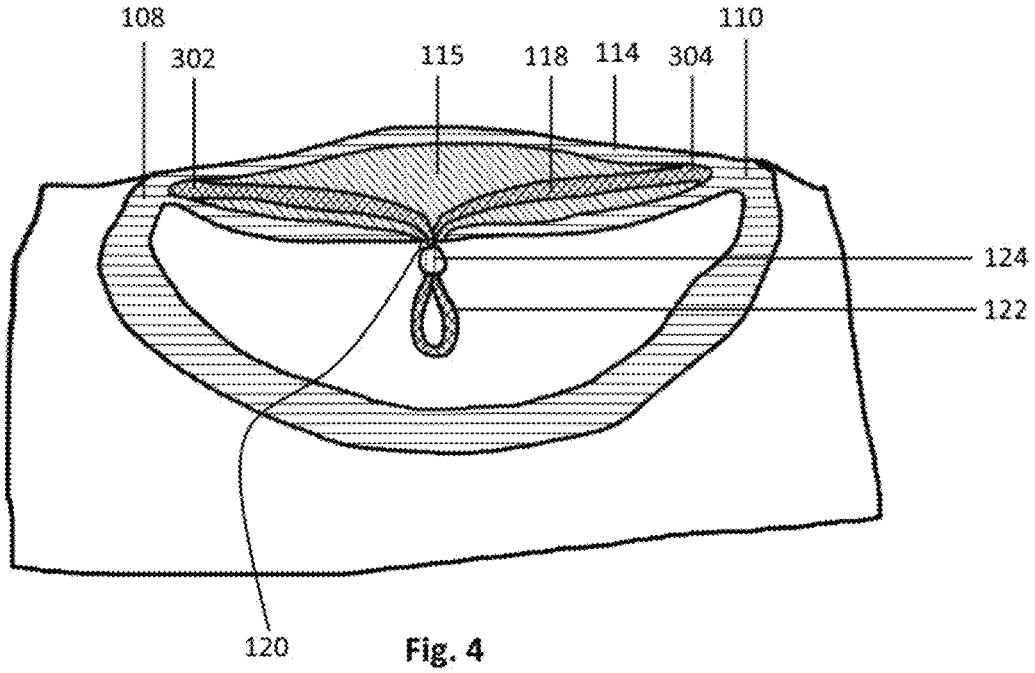
FIG. 4 shows a cut-away view of a back channel of the exemplary neckline fitting system.

FIG. 4 shows the same as FIG. 3 except with a different length of the middle portion protruding through the back channel.

Figure 5:
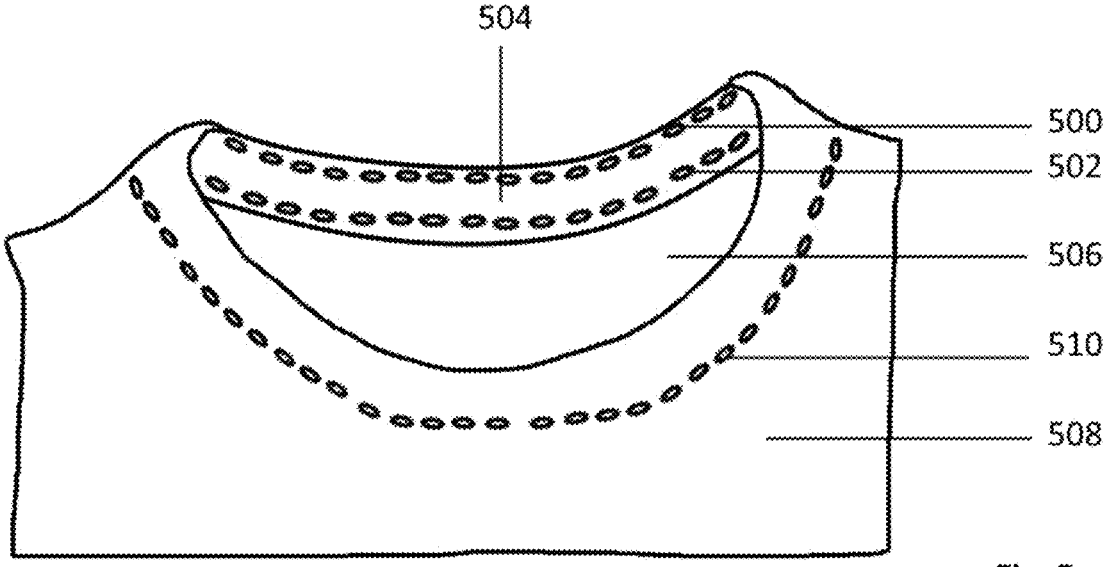
FIG. 5 shows an exterior view of an exemplary neckline fitting system.

FIG. 5 shows a primarily exterior view of the fourth embodiment described previously, in which the upper 500 and lower 502 perimeters of the first elastic member 504 are sewn onto the interior portion 506 of the neckline. The sew lines 510 of the lower perimeter can be seen on the exterior portion 508 of the neckline.

Figure 6:
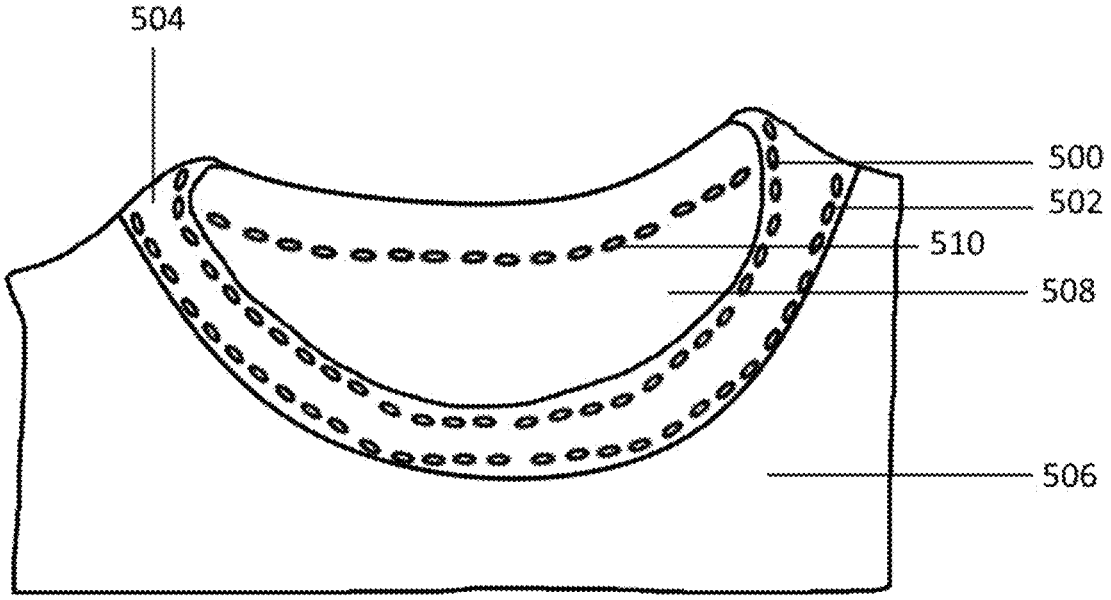
FIG. 6 shows an interior (i.e., inside-out) view of an exemplary neckline fitting system.

FIG. 6 shows a primarily interior view (i.e., inside-out view) of the fourth embodiment shown in FIG. 5. As seen, the neckline fitting system here lacks a bound bias.

The invention claimed is:

1. A neckline fitting system comprising a piece of apparel with a neckline, a set of channels, a set of elastic members, and a fastening tab, a. with the piece of apparel being a shirt or dress;

b. with the neckline configured to surround a wearer's neck and having a front side, a back side, a left side, and a right side, with the left and right sides each being attached to each of the front and back sides;

c. with the piece of apparel configured to be worn such that the front side of the neckline is approximately below a wearer's chin and the back side of the neckline is approximately below a wearer's nape;

d. with the set of channels being formed by material of the neckline, with the material sewn so that each of the set of channels form hollow spaces through which the set of elastic members are disposed;

e. with the set of channels comprising a first channel and a second channel;

f. with the first channel spanning the left side, front side, and right side of the neckline;

g. with the second channel spanning the left side, back side, and right side of the neckline;

h. with the second channel having an opening in approximately a middle of the back side;

i. with the set of elastic members comprising a first elastic member and a second elastic member;

j. with the first elastic member being disposed in the first channel and the second elastic member being disposed in the second channel;

k. with the first elastic member being a substantially flat band, i. with the first elastic member having a first and second end, with the first end of the first elastic member being attached to the left side of the neckline and the second end of the first elastic member being attached to the right side of the neckline;

l. with the second elastic member having a first end, a second end, and a middle portion, i. with the first end of the second elastic member being attached to the left side of the neckline and the second end of the second elastic member being attached to the right side of the neckline, ii. with the middle portion of the second elastic member being positioned between the first and second ends of the second elastic member;

iii. with the middle portion of the second elastic member protruding through the opening of the second channel;

m. with the fastening tab being coupled to the middle portion of the second elastic member and configured to control a length of the middle portion of the second elastic member protruding through the opening of the second channel.

2. The neckline fitting system of claim 1, with the first and second elastic members being distinct elastic members.

3. The neckline fitting system of claim 1, with the first end of the first elastic member being attached to the first end of the second elastic member.

4. ON The neckline fitting system of claim 1, with the first elastic member being made of rubber.

5. The neckline fitting system of claim 1, with the second elastic member being an elastic string or cord.

6. The neckline fitting system of claim 1, with the second elastic member being a drawstring.

7. The neckline fitting system of claim 1, with the first elastic member having higher elasticity than the second elastic member.

8. The neckline fitting system of claim 1, with the elastic member being a drawstring.

9. A neckline fitting system comprising a piece of apparel with a neckline and a first elastic member;

a. with the piece of apparel being a shirt or dress;

b. with the neckline configured to surround a wearer's neck and having a front side, a back side, a left side, and a right side, with the left and right sides each being attached to each of the front and back sides;

c. with the piece of apparel configured to be worn such that the front side of the neckline is approximately below a wearer's chin and the back side of the neckline is approximately below a wearer's nape;

d. with the first elastic member having an upper perimeter and a lower perimeter;

e. with the upper perimeter sewn along an edge of the neckline and the lower perimeter sewn along an area running adjacent to the edge of the neckline;

f. with the first elastic member being a substantially flat band.

10. The neckline fitting system of claim 9, with the first elastic member sewn along the front side of the neckline.

11. The neckline fitting system of claim 9, with the first elastic member sewn along the front and back sides of the neckline.

12. The neckline fitting system of claim 9, with the first elastic member sewn along the front side but not the back side of the neckline.

13. The neckline fitting system of claim 9, additionally comprising a back channel, a second elastic member, and a fastening tab, a. with the second elastic member being disposed through the back channel, b. with the back channel comprising an opening;

c. with the opening configured to enable a middle portion of the second elastic member to pass through forming a loop;

d. with the fastening tab being coupled to the middle portion of the second elastic member and configured to control a length of the middle portion of the second elastic member protruding through the opening of the back channel.

14. The neckline fitting system of claim 9, with the first elastic member having a first and second end, with the first end of the elastic member being attached to the left side of the neckline and the second end of the elastic member being attached to the right side of the neckline.

15. The neckline fitting system of claim 9, with the first elastic member having a first and second end, with the first end and second end of the elastic members each being attached to a given side of the neckline, with the given side being the front side, the back side, the left side, the right side of the neckline, between the front and left side, between the front and right side, between the back and left side, or between the back and right side of the neckline.

16. A neckline fitting system comprising a piece of apparel with a neckline, a back channel, an elastic member, and a fastening tab, a. with the piece of apparel being a shirt or dress;

b. with the neckline configured to surround a wearer's neck and having a front side, a back side, a left side, and a right side, with the left and right sides each being attached to each of the front and back sides;

c. with the piece of apparel configured to be worn such that the front side of the neckline is approximately below a wearer's chin and the back side of the neckline is approximately below a wearer's nape;

d. with the back channel being formed by material of the neckline, with the material sewn so that the back channel forms a hollow space through which the elastic member is disposed;

e. with the back channel spanning at least the left side, back side, and right side of the neckline;

f. with the back channel having an opening in approximately a middle of the back side;

g. with the elastic member being disposed in the back channel;

h. with the elastic member having a first end, a second end, and a middle portion, i. with the middle portion of the elastic member being positioned between the first and second ends of the elastic member;

ii. with the middle portion of the elastic member protruding through the opening of the back channel;

i. with the fastening tab being coupled to the middle portion of the elastic member and configured to control a length of the middle portion of the elastic member protruding through the opening of the back channel.

17. The neckline fitting system of claim 16, with the first end of the elastic member being attached to the left side of the neckline and the second end of the elastic member being attached to the right side of the neckline.

18. The neckline fitting system of claim 16, additionally comprising a front channel;

a. With the front channel spanning at least the left side, front side, and right side of the neckline;

b. with the first end and second end of the elastic member each being attached to a given side of the neckline, with the given side being the front side, the back side, the left side, the right side of the neckline, between the front and left side, between the front and right side, between the back and left side, or between the back and right side of the neckline.

19. The neckline fitting system of claim 18, with the elastic member being configured to pass freely through the front and back channels.

20. The neckline fitting system of claim 16, with the elastic member being an elastic string or cord.

* * * * *